United States Patent [19]

Dabney

[11] Patent Number: 4,861,002

[45] Date of Patent: Aug. 29, 1989

[54] SPRING MODULE WITH IMPROVED MOUNTING FOOT STRUCTURE

[75] Inventor: Upton R. Dabney, Georgetown, Ky.

[73] Assignee: Hoover Group, Inc., Roswell, Ga.

[21] Appl. No.: 237,845

[22] Filed: Aug. 29, 1988

[51] Int. Cl.[4] ..... A47C 23/02; F16F 3/04

[52] U.S. Cl. ..... 267/103; 5/247; 5/264 R; 24/626; 403/208; 403/209

[58] Field of Search ..... 267/103, 104, 105, 106, 267/107, 108, 109, 110, 111; 5/476, 247, 255, 260, 261, 263, 264 R; 403/208, 209; 24/296, 626

[56] References Cited

U.S. PATENT DOCUMENTS

| | | | |
|---|---|---|---|
| 2,099,189 | 11/1937 | Ball | 24/626 X |
| 2,115,179 | 4/1938 | Ross | 24/626 |
| 2,249,910 | 7/1941 | Place | 24/626 |
| 3,680,157 | 8/1972 | Slominski et al. | 5/247 |
| 3,971,081 | 7/1976 | Roe | 5/246 |

FOREIGN PATENT DOCUMENTS

| | | | |
|---|---|---|---|
| 24419 | 4/1919 | Denmark | 24/626 |
| 4313 | 5/1900 | United Kingdom | 24/626 |

*Primary Examiner*—George E. A. Halvosa
*Attorney, Agent, or Firm*—Harness, Dickey & Pierce

[57] ABSTRACT

In a box spring assembly having a frame, including a frame rail member with horizontally spaced generally upright side walls. The frame rail has a plurality of aligned horizontal slots through the upright side walls and arranged in aligned pairs. Wire spring modules having U-shaped mounting feed extending through the aligned slots are mounted on the rail. A mounting foot has a pair of spaced apart leg portions joined together by a connecting portion spring urging the leg portions apart. Each leg portion has a pair of spaced bearing sections for engaging the ends of pairs of slots in the side walls of the frame rail, and an outwardly convex retaining portion between the bearing sections for coacting with the side walls to retain the foot in the pair of slots in the frame rail.

5 Claims, 2 Drawing Sheets

SPRING MODULE WITH IMPROVED MOUNTING FOOT STRUCTURE

BACKGROUND AND SUMMARY OF THE INVENTION

This invention relates generally to mattress foundation structures and more particularly to a box spring assembly having a frame and springs having mounting feet secured to the frame.

A box spring assembly typically has a horizontal frame which is rectangular in shape. Spaced above and generally parallel to the frame is a mattress support deck made of wire. A plurality of deck support spring modules are interposed between the frame and the wire deck to yieldably resist bedding loads on the box spring assembly. The spring modules generally have deck attaching portions at the upper end and mounting foot portions at the lower end of the modules.

The rectangular frame typically has metal or wood rails of a type shown in U.S. Pat. Nos. 3,680,157 and 3,755, 833. The typical mounting foot of a spring module disclosed in these patents is either stapled to the wood frame rail member or inserted through horizontal slots in the metal frame rail members. These prior art mounting feet are generally U-shaped horizontal wire portions at the bottom end of the spring module.

Each foot comsists of a pair of spaced legs spring urged apart. One straight leg is connected to the upright yieldable portion of the spring module and forms a horizontal torsin bar which frictionally rubs against one end of the slots in the rail member. The other leg is connected to the first leg by a connecting portion and terminates in a book shaped free end. The hook shaped end straddles one end of one slot in the frame rail to prevent dislocation of the mounting foot from the slots in the frame rail member. This leg also urges the other leg into engagement with the ends of the slot to provide firm engagement of the mounting foot within the slots.

One disadvantage of spring modules having a mounting foot structure according to these prior art designs is that the hook portion is the primary portion of the U-shaped foot that retains the foot within the slot. Thus the retention forces under loaded conditions tend to concentrate at the hooked portion.

Another disadvantage in the prior art designs is that horizontal twisting loads and impact loads applied to the spring modules tend to dislodge the straight torsion bar leg of the mounting foot from the slot ends. Under heavy shock loading, the mounting foot in spring modules of the prior art designs may shift out of the engaged position with the slot ends without properly realigning and remain in an unbalanced condition. This can generate undesirable noise.

It is therefore an object of the present invention to provide a mounting foot structure which evenly distributes the retention forces present between both legs of the mounting foot, thus more evenly distributing wear and more firmly securing the foot within the frame rail member.

It is another object of the present invention to provide a mounting foot structure having a retaining portion on the torsion bar leg to improve the retention characteristics of the foot under horizontal twisting loads and impact loading conditions.

A spring module for a box spring assembly according to the present invention is designed for use with a box spring frame rail having horizontally spaced generally upright side walls joined by a horizontal connecting portion forming an inverted U-shaped channel member. The frame rail has a plurality of aligned pairs of slots through the upright side walls spaced along the length of the rail. Each slot has a central portion and opposing closed ends which form end bearing portions of substantially C-shape. Such a slotted frame rail is shown in copending application Ser. No. 72,964, filed July 14, 1987, Pat. No. 4,779,292 assigned to the assignee of this application and the disclosure of which is incorporated herein by reference.

The spring module has an upright yieldable portion supported on the rail member by a generally U-shaped horizontal mounting foot at the lower end of the upright yieldable portion. The mounting foot is a generally U-shaped wire portion of the spring module comprising a pair of spaced leg portions joined together by a connecting portion which spring urges the leg portions apart. Each of the leg portions has a pair of spaced bearing sections that are straight for engaging the end bearing portions at one end of one pair of slots in the side walls of the frame rail. Between the bearing sections, each leg portion has an outwardly convex retaining portion which coacts with the side walls to retain the leg portion in the slots. As the leg portions are spring urged apart by the connecting portion, the two outwardly convex retaining portions distribute the retention forces during twisting of the spring module to firmly retain the mounting foot within slots in the frame rail member.

The combination of a pair of spaced bearing sections separated by an outwardly convex retaining portion minimizes the amount of friction between the bearing sections of the leg portions and the end bearing portions of the slots during torsional movement of the leg portion connected to the upright yieldable portion of the spring module. In addition, the improved mounting foot utilizing a pair of spaced straight bearing sections balances the mounting forces so that equal loading is maintained on both ends of the slots in the frame rails while the foot is maintained in a fixed position. Any rotational forces tending to move the foot out of position are deflected against the upright walls of the frame rails thus eliminating movement and therefore noise. The spring module having an improved mounting foot structure in accordance with the present invention also has a longer installed life and is more stable under shock and impact loading.

Other objects, features and advantages of the present invention will become apparent from a consideration of the following description and the appended claims when taken in conjunction with the accompanying drawing.

DETAILED DESCRIPTION OF THE INVENTION

Figure 1:
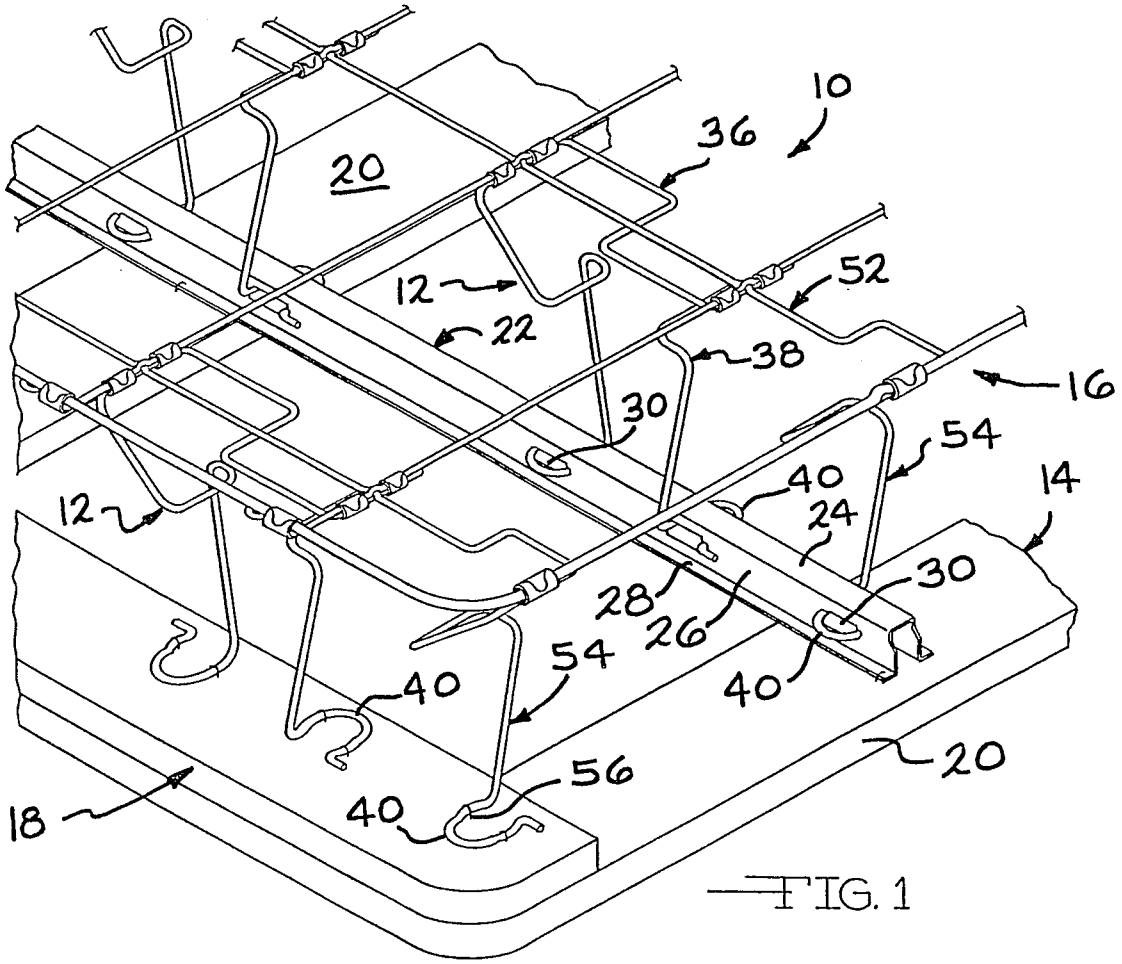
FIG. 1 is fragmentary perspective view of a box spring assembly incorporating spring modules with the improved mounting foot structure according to the present invention.

With reference to the drawing, a box spring assembly indicated generally at 10 is shown in FIG. 1. The box spring assembly 10 comprises a plurality of load suporting spring modules 12 secured to and between a frame 14 and a mattress support deck made of crisscrossed wire members 16.

Figure 5:
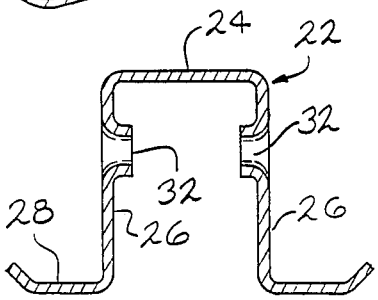
FIG. 5 is a sectional view of the cross rail taken along the line 5—5 in FIG. 4.

The frame 14 is a generally rectangular arrangement having end rails 18 and side rails 20. A plurality of cross rails 22, only one of which is shown in FIG. 1, are supported on and extend between the side rails 20. As shown in FIGS. 1 and 5, each cross rail 22 is generally of an inverted U-shape in cross section having a horizontal top 24 and a pair of horizontally spaced downwardly depending upright walls 26. Each of the walls 26 terminates at its lower end in an outwardly extending generally horizontal flange 28.

Each cross rail 22 has formed in its upright wall sections 26 a plurality of slots 30, each of which extends longitudinally of the rail 22. The slots 30 are arranged in horizontally aligned pairs for supporting the spring modules 12 as will be subsequently described.

Figure 3:
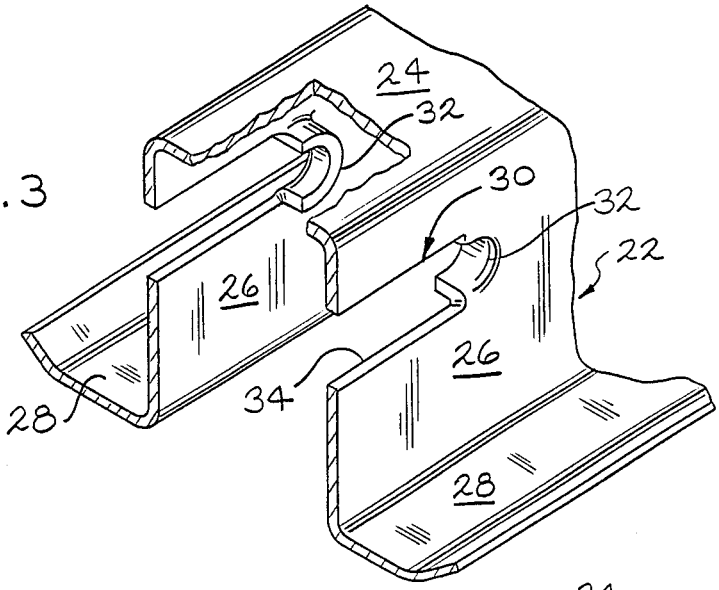
FIG. 3 is an enlarged perspective view of a fragmentary portion of the frame cross rails shown in FIG. 2.
Figure 4:
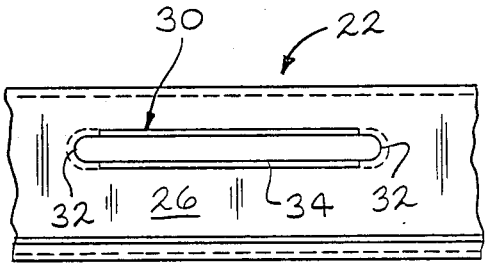
FIG. 4 is a side elevational view of a fragmentary portion of the cross rail shown in FIG. 3.

Each of the slots 30 has opposing closed ends forming end bearing portions 32 of substantially C-shape and a central portion 34. End bearing portions 32 are of reduced width in the vertical direction relative to the width of the central portion 34. The bearing portions 32 are also, as shown in FIG. 3, of increased thickness relative to the thickness of the upright walls 26. The end bearing portions 32 are formed by extruding metal from the upright walls 26 into the portions 32 so as to form them of the desired thickness.

Each of the spring modules 12 comprises an upper connecting portion 36 attached to the mattress support deck 16, a pair of upright yieldable portions 38 and a pair of mounting feet 40. Each foot 40 includes a pair of spaced legs 42 and 44 joined at one end and spring urged apart by a connecting section 46.

Figure 2:
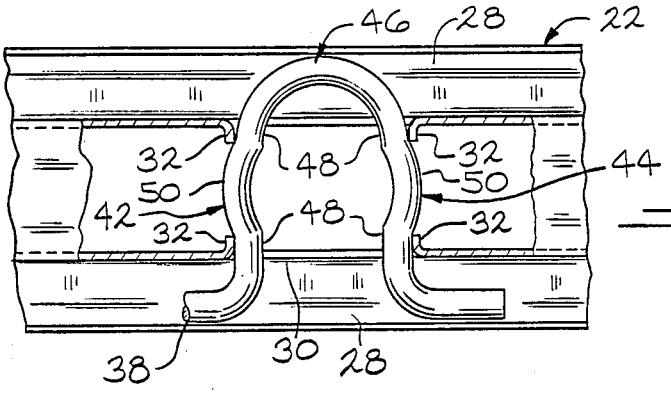
FIG. 2 is an enlarged fragmentary top view of a cross rail in the box spring assembly shown in FIG. 1 with portions broken away revealing the mounting foot according to the present invention.

A mounting foot 40 is shown positioned in the slots 30 in the cross rail 22 in the enlarged fragmentary view of FIG. 2. The leg 42 is integrally connected at one end to the upright yieldable portion 38. The legs 42 and 44 each have two straight spaced bearing sections 48 engaged with the end bearing portions 32 at one end of the slots 30. Between and joining the bearing sections 48 is an outwardly convex retaining portion 50.

The legs 42 and 44 are biased apart by the connecting portion 46 such that the bearing sections 48 are firmly engaged with the end bearing portions 32, and the convex retaining portions 50 are wedged between the upright walls 26 at both ends of the slots 30.

The leg 42 forms a torsion bar extending horizontally into the slot 30 and is connected to the leg 44 by the connecting section 46 at the other end of the torsion bar. When the spring module 12 is deflected downward under normal loading conditions, the torsion bar leg 42 twists absorbing a portion of the load. This twisting causes frictional wear between the bearing sections 48 of the feet 40 and the contacting end bearing portions 32 of the slots 30. However, the bearing sections 48 lie parallel to the surface of the end bearing portions 32 minimizing frictional wear, thus prolonging life of the spring module and minimizing objectional noise.

The symmetrical arrangement of the legs 42 and 44 in bearing engagement with the bearing portions 32 distributes the loading on the mounting foot at four points. This minimizes the loading on any one end of a slot. In addition, having two outwardly convex retaining portions 50 disposed between the upright wall sections 26 of the cross rail 22 firmly secures the mounting foot 40 onto the cross rail 22.

As shown in FIG. 1, a cross spring 52 also forms a part of the mattress support deck 16. The cross spring 52 includes a pair of upright yieldable portions 54 at each end, only one of which is shown in FIG. 1. The other upright yieldable portion of the spring 52 is of identical design. The upright portions 54 of the cross spring 52 terminate in a pair of mounting feet 40 identical to those on the spring module 12 described above.

The foot 40 of spring module 12 or cross spring 52 may also be mounted to a wood rail such as end rail 18 as shown in FIG. 1. In this case the mounting foot 40 is stapled in place with conventional staples 56.

The spring module thus formed incorporating the improved mounting foot structure of the present invention is securely held with the foot between the upright walls 26 of the cross rails 22 thereby resulting in a stronger and quieter box spring assembly 10 that can withstand severe shock loads. The spring module also has an improved life span due to the decreased wear inherent in the more secure mounting foot structure.

While the above description constitutes the preferred embodiment of the present invention, it will be appreciated that the invention is susceptible to modification, variation and change without departing from the proper scope and fair meaning of the accompanying claims.

What is claimed is:

1. In a box spring assembly having a frame including at least one frame rail member with horizontally spaced generally upright side walls having a pair of aligned horizontal slots therethrough, said slots having closed ends, each of said ends having a bearing surface, at least one wire spring module having an upright yieldable portion supported on said rail member by a generally U-shaped mounting foot at the lower end of said upright portion, said foot being insertable within said pair of slots, said foot comprising a pair of spaced leg portions joined together by a connecting portion spring urging said leg portions apart, at least one of said leg portions having a pair of spaced bearing sections at least one of said bearing sections being parallel to said bearing surfaces for engaging said bearing surfaces of said ends at one end of said pair of slots in side walls of said frame rail member, said one leg portion having an outwardly convex retaining portion between said bearing sections for wedging coaction with said side walls of said frame rail member to retain said foot in said pair of slots in said frame rail.

2. The wire spring module according to claim 1 wherein said one of said leg portions joins said upright portion forming a generally horizontal torsion bar between said upright portion of said spring module and the other leg portion of said foot.

3. The wire spring module according to claim 2 wherein said other leg of said foot comprises an outwardly convex locking portion spaced between a pair of bearing sections for coacting with said frame rail member at the other closed end of said pair of slots to retain said foot in said slots.

4. In a box spring assembly having a frame having cross rails and a plurality of load supporting spring modules mounted on the cross rails wherein one of said rails has at least a portion of a generally inverted U-shape with a pair of spaced upright webs having a pair of aligned closed slots in said webs, each of said slots having an elongated central section and end bearing portions of substantially C-shape, each having a bearing surface, at least one of said spring modules having an upwardly extending portion and a generally U-shaped foot portion shaped to extend through said aligned slots and rotatably engage the end bearing portions at opposite ends of said slots, said foot portion comprising:

a pair of spaced legs which are spring urged in directions away from each other, one of said legs being pressed into substantially parallel bearing engagement with said bearing surface of at least one of said end bearing portions, said one leg having an outwardly convex retaining section engaged between said aligned slots in said webs, said one leg forming a torsion bar joining with said upwardly extending portion, the other of said legs engaging the other end of said slots to press said one leg into bearing and retaining engagement with said webs of said cross rail.

5. The spring module according to claim 4 wherein said one leg has a pair of spaced bearing sections each parallel to the engaging end bearing portions at one end of said aligned slots.

* * * * *